US005383611A

United States Patent [19]

Falini et al.

[11] Patent Number: 5,383,611

[45] Date of Patent: Jan. 24, 1995

[54] DIRECT IN-LINE INJECTION OF PARTICULATE COMPOSITIONS IN SPRAYING SYSTEMS

[75] Inventors: Jeffery P. Falini, Bear, Del.; Lawrence D. Gaultney, Elkton, Md.

[73] Assignee: E. I. du Pont de Nemours and Company, Wilmington, Del.

[21] Appl. No.: 134,238

[22] Filed: Oct. 8, 1993

[51] Int. Cl.[6] ..... B02C 19/22

[52] U.S. Cl. ..... 241/30; 241/260.1

[58] Field of Search ..... 241/3, 30, 260.1, 259

[56] References Cited

U.S. PATENT DOCUMENTS

| | | | |
|---|---|---|---|
| 4,339,084 | 7/1982 | Eriksson | 241/259.2 X |
| 4,783,010 | 11/1988 | Kissel | 241/260.1 X |
| 4,836,460 | 6/1989 | Akazawa | 241/260.1 X |
| 4,997,137 | 3/1991 | Tolonen | 241/260.1 X |

OTHER PUBLICATIONS

William E. Hart, Larry D. Gaultney, Direct Injection of Dry Flowable Agricultural Pesticides, *Pesticide Formulations and Applications Systems,* 10, ASTM STP 1078, 1990.

*Primary Examiner*—Timothy V. Eley

[57] ABSTRACT

A method and apparatus for direct in-line injection of solid particulate compositions into conventional spraying systems, the apparatus including a screw designed to meter and reduce the particle size of the composition as it is transported from an inlet to an exit in the apparatus, the screw characterized by a constant depth portion adjacent to the inlet, air-tight seals at both the inlet and outlet end of the screw, and means for adjusting the longitudinal position of the screw.

5 Claims, 1 Drawing Sheet

DIRECT IN-LINE INJECTION OF PARTICULATE COMPOSITIONS IN SPRAYING SYSTEMS

BACKGROUND OF THE INVENTION

Direct-injection is becoming increasingly popular as a method of applying agricultural compositions. In this method, the composition is injected directly in a spray line without pre-dispersion in a spray tank containing water, and the spray tank serves merely as a reservoir of water. One significant advantage is that no agricultural composition enters the spray tank, and accordingly clean out of the spray tank is not necessary. Any unused composition can be easily stored and reused because it was not contacted with water or mixed with other compositions.

Because the hold-up time between injection and spraying is short, the composition must disperse almost instantaneously. Also, small amounts of composition must be metered accurately. For these reasons, liquid formulations such as emulsifiable concentrates (ECs) and suspension concentrates (SCs) have been preferred for direct injection. However, it would be advantageous to directly inject solid and particularly granular compositions because they have many desirable characteristics relative to liquids, including easier handling, storage, package disposal and less potential for worker exposure.

A tapered screw apparatus for direct-injection of granular materials is disclosed in "Direct Injection of Dry Flowable Agricultural Pesticides", *Pesticide Formulations and Applications Systems*, Vol. 10, ASTM STP 107B, Hart and Gaultney (1990). The present invention is an improvement of the apparatus disclosed therein and provides a simple, practical apparatus and method for direct-injection of particulate compositions.

SUMMARY OF THE INVENTION

The present invention includes an apparatus for metering dispersible or soluble particulate compositions into spray lines of conventional spraying equipment normally used in agriculture. Conventional spraying equipment includes the following type of sprayers: hydraulic nozzle, air assist, air atomizing, shielded, spot, hooded, banding, electrostatic and the like. Sprayers generally preferred for use in agriculture include hydraulic nozzle and air assist. The liquid medium being sprayed is usually aqueous based but need not be. Preferred particulate compositions for use with the apparatus and method of this invention are water-dispersible or water-soluble granular agricultural compositions. Wettable powders, however, could also be used.

The apparatus of the present invention includes a longitudinal screw housing having a cylindrical cavity, a screw positioned within said cylindrical cavity, the screw having flights designed to transport and reduce the particle size of the solid particulate composition that enters the housing and is placed in contact with the screw, inlet means for introducing solid particulate composition into the housing and in contact with the screw at one end of the housing, and outlet means for the solid particulate composition to exit the housing and enter the liquid spray system at the other end of the housing, means for rotating the screw relative to the housing, with the design of the housing and the screw such that with the screw rotating relative to the housing the solid particulate composition introduced into the inlet means will be transported along the length of the screw from the inlet means to the outlet means while being metered and reduced in particle size, the improvement comprising that the depth of the screw flights are substantially constant depth along the entire area of the screw adjacent to the inlet means.

In preferred embodiments of this invention, the screw is mounted within the housing such that the ends of the screw or a shaft that is supporting the screw form a seal with the respective ends of the housing such that if the inlet and outlet means are also sealed, then the cavity can be pressurized and neither the solid particulate composition nor any liquid that may enter the cavity will be able to exit the cavity other than through the outlet means; the shaft supporting the screw contains at least one groove around the circumference of the shaft at a location on the shaft between the last screw flight at the outlet end of the screw and the seal formed between the outlet end of the shaft of the screw and the outlet end of the housing, with the at least one groove positioned on the shaft at a location adjacent to the outlet means; and there are means for adjusting the longitudinal position of the screw within the housing and relative to the inlet means and/or the outlet means.

The present invention also includes a method of directly injecting a solid particulate composition into a liquid spray system comprising feeding the composition into the inlet means of the apparatus described above, rotating the screw such that the composition is transported along the length of the screw to the outlet means while being metered and reduced in particle size, and passing the composition through the outlet means and directly into the spray system.

Examples of particulate compositions that can be used in the method and apparatus of this invention include Accent®, Ally®, Classic®, Gemini®, Lexone® DF, New Lorox Plus®, Pinnacle®, and Preview® Herbicides all of which are water-dispersible granular compositions currently available from E.I. du Pont de Nemours and Company.

BRIEF DESCRIPTION OF THE DRAWINGS

The accompanying drawings, which are incorporated in and constitute a part of the specification, illustrate the presently preferred embodiments of this invention, and together with the general description given above and the detailed description of the preferred embodiments given below, serve to explain the principles of the invention.

DESCRIPTION OF THE PREFERRED EMBODIMENTS

Figure 1:
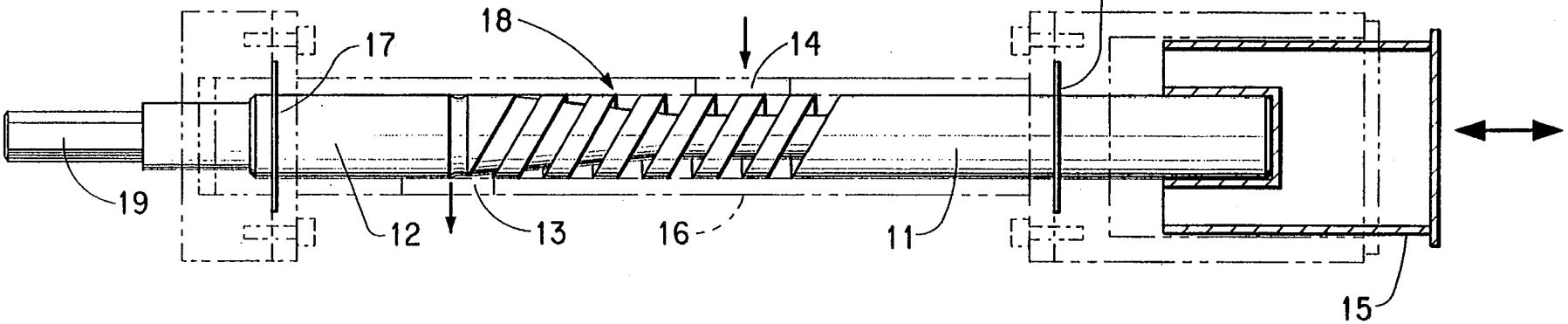
FIG. 1 is a schematic representation of a side view of one embodiment of the apparatus of the present invention.

Referring to FIG. 1, there is depicted a schematic of a side view of one embodiment of the apparatus. The longitudinal screw housing 16 having a cylindrical cavity has positioned within it a screw 18 having flights designed to transport and reduce the size of particulate composition that enters the housing by means of an inlet 14 which is adjacent to the screw at one end of the housing and exits the housing and can then be directly injected into the liquid spray stream at the other end by means of an outlet 13.

A charge hopper (not shown) capable of containing a suitable amount of particulate composition can be connected to and operated in cooperation with the inlet means such that there is free flow of composition through the inlet means and in turn to the inlet end of the screw. The hopper is preferably made of a material that is resistant to corrosion and that has a relatively low coefficient of friction. In a preferred embodiment, the hopper can be sealed substantially air-tight. In another preferred embodiment, the hopper can be pressurized. Normally a charge hopper will be mounted on top of, i.e., above, the apparatus of the present invention, and the particulate composition will be gravity fed to the inlet means. Alternative means for introducing particulate composition to the inlet means and sealing and pressurizing the apparatus can be used without departing from the present invention.

The inlet means connects the hopper to the housing and admits particulate composition to the constant-depth portion of screw. The inlet means includes a port in the housing which is at least the width of 1 flight and preferably at least 1.5 flights so that composition is preferably being feed to more than one screw-flight. The port is also of a dimension and location such that the particulate composition is always fed to the constant-depth portion of screw described hereinafter even when the longitudinal position of the screw is adjusted within the housing, as described hereinafter.

The outlet means comprises a port in the exit end of the housing and is adapted so that the port can be connected directly to a spray line in a conventional spray system such that the composition exiting the screw flights has free fall into the liquid in the spray line. The travel of the composition from the outlet means into the liquid in the spray line should be as short as possible to minimize the surface area of any equipment exposed to the composition in between the outlet and the spray line, thereby minimizing the need for subsequent clean out. Still, the travel should be long enough to prevent the liquid in the spray line from splashing up into the screw.

The means 15 for adjusting the longitudinal position of the screw within the housing adjusts the position of the screw flights relative to the inlet and outlet means which are in fixed position on the housing. The amount of adjustment is limited so that the inlet means will always feed to a constant-depth portion of screw flight.

Means for rotating the screw relative to the housing (not shown) is preferably adjustable so that rpm of the screw can be varied, and once adjusted it must hold constant so that a steady amount of particulate composition is transported from inlet to outlet and into the spray stream. Suitable means includes a variable speed motor coupled to the screw shaft such that the motor has sufficient power to turn the screw at suitable rpm. The coupling 19 of the rotating means to the shaft must be able to accommodate the longitudinal adjustment of the screw.

Close tolerances between the shaft ends, 11 and 12, and the respective portions of the housing can provide a seal to prevent passage of any solid composition other than through the outlet means. Preferably there are additional seals 17 at each end of the housing; such seals include standard lip seals (single, double or triple) or pressure sealing rings. Preferred are lip seals. In a preferred embodiment, the seals are capable of sustaining about 550 kPa pressure when the apparatus is pressurized, such as from a pressurized charge hopper.

Figure 2:
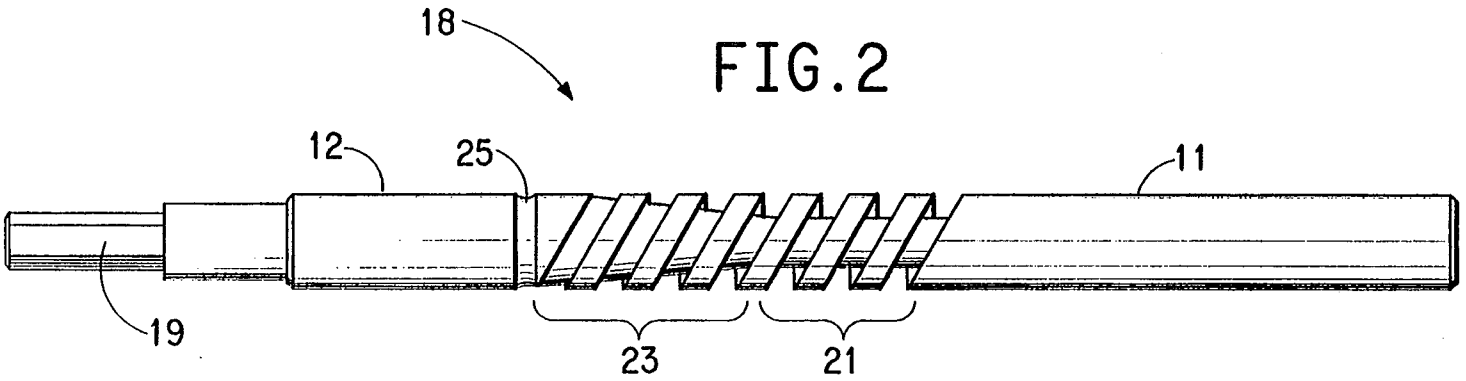
FIG. 2 is a schematic representation of a side view of one embodiment of the screw component of the apparatus of the present invention.

Referring to FIG. 2, there is depicted a schematic of a side view of the screw 18. Shown is a portion of flights 21 of constant depth at the inlet end of the screw, and a portion of flights 23 with a tapered shaft which become increasingly more shallow toward the outlet end. The constant-depth flights are preferably at least as deep as the diameter of the largest particle of the particulate composition, and preferably at least three times as wide as the diameter of the largest particle. The threads on the screw which form the flights can be any one of various shapes including triangular, square, rectangular, rounded or trapezoidal. Rectangular threads are preferred. The longitudinal distance between the center of the threads parallel to the screw axis is known as the pitch. Feed rate will be determined by the pitch, the depth of the threads, the slope of the threads, the shape of the threads and the speed at which the screw is rotated. The pitch chosen for screws useful in the apparatus of the present invention will preferably be from 0.1 to 3 per centimeter. A pitch of about 1 thread per centimeter is generally preferred for agricultural compositions in which the active ingredient is a sulfonylurea or materials of similar potency, which are generally applied at rates of ounces per acre. Of course, if less potent, larger volume compositions are used, a larger screw with a different screw configuration will be used to get the appropriate feed rate.

The groove 25 around the circumference of the shaft at a position on shaft between the last screw flight at the outlet end and the seal formed between the outlet end of the screw shaft and the outlet end of the housing helps prevent the exiting particulate composition from being forced into the outlet end seal 17 instead of dropping freely through the outlet into the spray stream. The groove is connected to the last flight, is at least as deep and wide as the last flight, and is smooth so as to avoid any points where solid composition might collect. Preferably the groove is deeper and wider than the last flight.

In the operation of the apparatus of the present invention, the particulate composition to be injected into the spray stream is loaded in the charge hopper and the hopper is preferably sealed. When the rotation of the screw is activated, the composition passes from the hopper, through the inlet means, into the constant-depth portion of screw-flight and is forced toward the outlet means. As the screw flights become increasingly shallow toward the outlet, the particulate composition is crushed. The composition leaves the screw and falls through the outlet means into the spray stream where it disperses or dissolves and is then sprayed on the locus to be treated.

By adjusting the longitudinal position of the screw within the housing, the amount of crush and feed rate of the particulate composition can be controlled. When the most shallow flight is positioned over the outlet means, the maximum crush and minimum feed rate (at a given rpm) is achieved. When the screw is adjusted to position a deeper flight over the outlet, less crush and higher feed rate is achieved. In any case, the design of the screw and the limits of adjustment insure that the flights being feed by the inlet means are constant depth. The amount of crush desirable will depend on the nature of the particulate composition being fed. For example, typical granular compositions will require a relatively large degree of particle size reduction to insure rapid dispersion or dissolution of the composition. Alternatively, typical wettable powder compositions will require little or no particle size reduction. Likewise, the feed rate depends the desired application rate, and is a function of rpm as well as screw position. As a matter of convenience, the screw is preferably designed to be operated in the range of 10–350 rpm.

By feeding the particulate composition to a constant depth portion of screw, rather than a tapered portion, pulsing is avoided and an even feed rate is achieved. Also, feeding to a constant depth portion of screw allows a linear, and thus more easily controllable, variation in feed rate as the screw is longitudinally adjusted.

Conventional spraying systems usually have an in-line pump to provide the pressure necessary for spraying the carrier liquid. The outlet means of the present invention can be coupled to the spray line on the suction (input) side of the pump or on the pressure (output) side. If the outlet means is coupled to the spray line on the suction side of the pump, the charge hopper is preferably sealed in a way that only a small, regulated amount of air is bled into the spray lines through the inlet means. The air bleed is needed to prevent a full vacuum from being created in the hopper and thereby causing water to be pulled back into the screw when the pump is shut off. If the outlet means is coupled to the spray line on the pressure side of the pump, the charge hopper is preferably sealed and pressurized with air so as to offset the pressure exerted by the pump and prevent any liquid from the spray stream from being forced up into the screw. The design of the hopper and the seals on the screw are such that they will withstand the pressure required for this mode of operation. The air pressure applied to the hopper is provided by standard means such as a compressor or a cylinder of compressed air.

In a preferred embodiment of this invention, the distance between the point at which the outlet means is coupled to the spray lines and the nozzles at the end of the spray line is as short as possible to minimize and more accurately control the delay associated with startup and shutdown of the apparatus, such as would occur at the beginning and end of each pass over a row or rows in an agricultural field.

The housing and screw can be made of any hard, wear-resistant material. Preferably the housing is stainless steel and the screw is stainless steel or hardcoat anodized aluminum. Other parts can be made of stainless steel, plastic or other non-resting, non-corroding materials.

The embodiments of the present invention are particularly advantageous in that a) there is flexibility to attach the outlet means of the apparatus of the present invention to the spray line on either the suction or pressure side of the pump; b) there will be no air pulled into the spray lines when on the suction side of the pump; c) there will be no liquid forced into the screw when the apparatus of the present invention is coupled to the spray line on the pressure side of the pump; d) an even and linearly adjustable feed rate is achieved by feeding composition to a constant-depth portion of the screw; and e) forcing of composition through the outlet seal is prevented by providing a groove in the shaft adjacent to the last flight at the outlet end of the screw.

Those skilled in the art, having benefit of the teachings provided hereinbefore, will be able to devise numerous alternative embodiments. These embodiments are to be construed as being encompassed within the scope of the present invention as set forth in the appended claims.

EXAMPLE 1

In one embodiment of the present invention, a screw as shown in FIG. 2 was fabricated from stainless steel such that the diameter of the shaft 11 and 12 is 1.91 cm, the width of each thread is 0.64 cm, the width of the spacing between each thread is 0.64 cm, the depth of each thread in the constant depth portion 21 is 0.48 cm, the number of threads in the constant depth portion is 3, and the total number of threads is 7. In addition the groove 25 is 1.27 cm wide and 0.13 cm deep. The housing 16 contains an inlet port 14 oblong in shape, 1.91 cm in length and 0.64 cm in width and an outlet port 13 oblong in shape, 2.54 cm in length and 0.64 cm in width, with the inlet and outlet ports positioned on opposite sides of the housing and at locations along the length of the housing such that the centers of the inlet and outlet ports are 6.35 cm apart.

The position of the screw within the housing was adjusted to the "full open" position, i.e. with the inlet port at the first screw flight. The screw was rotated at various speeds and various commercially available water-dispersible granular agricultural compositions were introduced into the inlet port. Also introduced was a placebo granular composition which simulated the size and texture of Accent® Herbicide but contained no active ingredient. The throughput of the various compositions at the various rates was measured, and the results are summarized in Table I below. Where more than one measurement was made at a given set of conditions, the results shown are the average of the replications.

TABLE I

| Composition | Screw Speed (RPM) | Throughput (g/min) |
|---|---|---|
| Accent ® Herbicide | 25 | 6.65 |
| | 50 | 14.68 |
| | 150 | 41.54 |
| Ally ® Herbicide | 25 | 7.68 |
| | 50 | 20.00 |
| | 150 | 52.81 |
| Classic ® Herbicide | 25 | 7.03 |
| | 50 | 17.09 |
| | 150 | 45.57 |
| Escort ® Herbicide | 25 | 7.55 |
| | 50 | 16.25 |
| Placebo | 25 | 8.15 |
| | 50 | 15.43 |
| | 150 | 46.54 |

EXAMPLE 2

In another embodiment of the present invention, a screw as shown in FIG. 2 was fabricated from anodized aluminum such that the diameter of the shaft 11 and 12 is 2.54 cm, the width of each thread is 0.64 cm, the width of the spacing between each thread is 0.64 cm, the depth of each thread in the constant depth portion 21 is 0.32 cm, the number of threads in the constant depth portion is 3, and the total number of threads is 7. In addition the groove 25 has a 0.32 cm radius. The housing 16 contains an inlet port 14 oblong in shape, 1.91 cm in length and 0.64 cm in width and an outlet port 13 oblong in shape, 2.54 cm in length and 0.64 cm in width, with the inlet and outlet ports positioned on opposite sides of the housing and at locations along the length of the housing such that the centers of the inlet and outlet ports are 6.35 cm apart.

The position of the screw within the housing was adjusted to the "full open" position, i.e. with the inlet port at the first screw flight. The screw was rotated at various speeds and the placebo granular composition, as in Example 1, was introduced into the inlet port. The throughput at the various rates was measured, and the results are summarized in Table II below. Where more than one measurement was made at a given set of conditions, the results shown are the average of the replications.

| Composition | Screw Speed (RPM) | Throughput (g/min) |
|---|---|---|
| Placebo | 25 | 8.53 |
| | 50 | 16.36 |
| | 150 | 46.37 |

What is claimed is:

1. A method of directly injecting a solid particulate composition into a liquid spray system comprising feeding the composition into the inlet means of an apparatus for direct injection of a solid particulate composition into a liquid spray system, the apparatus comprising a longitudinal screw housing having a cylindrical cavity, a screw positioned within said cylindrical cavity, the screw having flights designed to transport and reduce the particle size of the solid particulate composition that enters the housing and is placed in contact with the screw, inlet means for introducing solid particulate composition into the housing and in contact with the screw at one end of the housing, and outlet means for the solid particulate composition to exit the housing and enter the liquid spray system at the other end of the housing, means for rotating the screw relative to the housing, with the design of the housing and the screw such that with the screw rotating relative to the housing the solid particulate composition introduced into the inlet means will be transported along the length of the screw from the inlet means to the outlet means while being metered and reduced in particle size, the improvement comprising that the depth of the screw flights are substantially constant depth along the entire area of the screw adjacent to the inlet means, rotating the screw such that the composition is transported along the length of the screw to the outlet means while being metered and reduced in particle size, and passing the composition through the outlet means and directly into the spray system.

2. In an apparatus for direct injection of a solid particulate composition into a liquid spray system, the apparatus comprising a longitudinal screw housing having a cylindrical cavity, a screw positioned within said cylindrical cavity, the screw having flights designed to transport and reduce the particle size of the solid particulate composition that enters the housing and is placed in contact with the screw, inlet means for introducing solid particulate composition into the housing and in contact with the screw at one end of the housing, and outlet means for the solid particulate composition to exit the housing and enter the liquid spray system at the other end of the housing, means for rotating the screw relative to the housing, with the design of the housing and the screw such that with the screw rotating relative to the housing the solid particulate composition introduced into the inlet means will be transported along the length of the screw from the inlet means to the outlet means while being metered and reduced in particle size, the improvement comprising that the depth of the screw flights are substantially constant depth along the entire area of the screw adjacent to the inlet means.

3. In the apparatus of claim 2, the further improvement comprising that, the screw is mounted within the housing such that the ends of the screw or a shaft that is supporting the screw form a seal with the respective ends of the housing such that if the inlet and outlet means are also sealed, then the cavity can be pressurized and neither the solid particulate composition nor any liquid that may enter the cavity will be able to exit the cavity other than through the outlet means.

4. In the apparatus of claim 2, the further improvement comprising that the shaft supporting the screw contains at least one groove around the circumference of the shaft at a location on the shaft between the last screw flight at the outlet end of the screw and the seal formed between the outlet end of the shaft of the screw and the outlet end of the housing, with the at least one groove positioned on the shaft at a location adjacent to the outlet means.

5. In the apparatus of claim 2, the further improvement comprising a means for adjusting the longitudinal position of the screw within the housing and relative to the inlet and outlet means.

* * * * *